US005249711A

United States Patent [19]

Filbert, Jr.

[11] Patent Number: 5,249,711

[45] Date of Patent: Oct. 5, 1993

[54] DISPOSABLE DISPENSING PIPETTE

[75] Inventor: William C. Filbert, Jr., Wilmington, Del.

[73] Assignee: Du Pont Canada Inc., Mississauga, Canada

[21] Appl. No.: 955,557

[22] Filed: Oct. 1, 1992

[51] Int. Cl.[5] ..... B67D 5/58

[52] U.S. Cl. ..... 222/189; 222/207; 222/420; 604/295; 422/100

[58] Field of Search ..... 222/83, 189, 212, 325, 222/207, 420, 460, 209; 604/295, 414; 422/100

[56] References Cited

U.S. PATENT DOCUMENTS

| | | | |
|---|---|---|---|
| 3,932,277 | 1/1976 | McDermott et al. | 210/77 |
| 4,135,883 | 1/1979 | McNeil et al. | 422/72 |
| 4,483,825 | 11/1984 | Fatches | 422/100 |
| 4,534,465 | 8/1985 | Rothermel et al. | 206/443 |
| 4,563,104 | 1/1986 | Saint-Amand | 222/209 X |
| 4,811,866 | 3/1989 | Golias | 222/189 |
| 4,925,065 | 5/1990 | Golias | 222/189 |
| 4,927,062 | 5/1990 | Walsh | 604/295 X |
| 5,030,341 | 7/1991 | McEwen et al. | 210/94 |

FOREIGN PATENT DOCUMENTS

| | | | |
|---|---|---|---|
| 0348116 | 12/1989 | European Pat. Off. . | |
| 659217 | 10/1951 | United Kingdom | 222/420 |

*Primary Examiner*—Gregory L. Huson

[57] ABSTRACT

Apparatus for dispensing blood or blood components from a stoppered vial containing such components. The apparatus comprises a combination of a flexible elongated hollow cone, a unitary cap and a dispensing end. The flexible elongated hollow cone tapers from an inlet end to a dispensing end, each end having external threads. The unitary cap is in threaded engagement with the external threads of the inlet end of the cone, with an internal gasket forming an effective seal between the end of the hollow cone and the interior of the unitary cap. The unitary cap has an axial tubular piercing bayonet extending outwardly therefrom with dimensions suitable for penetration of a stopper on a stoppered vial without coring. The dispensing end terminates in a tip with a fluid channel for the dispensing of droplets of liquid from the tip. The dispensing end has a threaded cap in threaded engagement with the external threads on the dispensing end of the cone, such external threads being effective in permitting controlled pressure equalization between the interior of the hollow cone and the atmosphere on removal of the cap.

8 Claims, 3 Drawing Sheets

DISPOSABLE DISPENSING PIPETTE

FIELD OF THE INVENTION

The present invention is directed to a disposable dispensing pipette, especially a pipette for the dispensing of blood or components of blood from a stoppered vial. In particular, the pipette is adapted for the dispensing of blood fractions formed as a result of centrifuging of blood samples or by other separation techniques in preparation for blood tests in hospitals or other institutions. In preferred embodiments, the vial and dispensing pipette may be disposed of after use e.g. by incineration.

BACKGROUND OF THE INVENTION

Diagnostic tests frequently require separation of a patient's whole blood sample into components, especially cellular portions from non-cellular portions e.g. serum or plasma from cells. For instance, plasma is obtained from anticoagulated blood and still contains all of the coagulation proteins, whereas serum is obtained from clotted blood with the bulk of the coagulation proteins being retained with the clot and red blood cells. Samples of whole blood are typically collected by venipuncture through a special cannula or needle attached to a syringe or an evacuated collection tube. The sample of blood in the form that is to be separated into components is typically drawn, using a needle, through a penetrable self-sealing elastomeric closure or other stopper into an evacuated tube or vial. Separation is then accomplished e.g. by rotation of the tube or vial in a conventional centrifuge e.g. a swinging bucket or a fixed angle centrifuge, or in an axial centrifuge as the different components of the whole blood have different densities.

The separated blood components normally must be removed from the stoppered vial prior to any tests being carried out on the blood component. Removal of the stopper from the vial could result in contamination of the sample and in particular could be hazardous to the person removing the stopper e.g. through contact with the blood component. Dispensing devices for removal of blood components or samples thereof are known e.g. as disclosed in U.S. Pat. Nos. 4,811,866 and 4,925,065 of T. L. Golias, published European patent application 0,348,116, also of T. L. Golias, and U.S. Pat. No. 5,030,341 of J. A. McEwen et al.

A more versatile dispensing pipette with important safety features has now been found.

SUMMARY OF THE INVENTION

Accordingly, the present invention provides apparatus for dispensing blood or blood components from a stoppered vial containing such components, comprising in combination:

(a) a flexible elongated hollow cone that tapers from an inlet end to a dispensing end, each of said ends having external threads;

(b) a unitary cap in threaded engagement with the external threads of the inlet end of the cone, said unitary cap having an internal gasket forming an effective seal between the end of the hollow cone and the interior of the unitary cap, said unitary cap having a tubular piercing bayonet extending outwardly from said cap with dimensions suitable for penetration of a stopper on a stoppered vial without coring;

(c) said dispensing end terminating in a tip with a fluid channel for the dispensing of droplets of liquid from said tip, said dispensing end having a threaded cap in threaded engagement with the external threads on the dispensing end of the cone, said external threads being effective in permitting controlled pressure equalization between the interior of the hollow cone and the atmosphere on removal of said cap.

In a preferred embodiment of the apparatus of the present invention, the tubular piercing bayonet is axial and linear.

BRIEF DESCRIPTION OF DRAWINGS

The present invention will be described with particular reference to the embodiments shown in the drawings in which.

DESCRIPTION OF PREFERRED EMBODIMENTS

Figure 1:
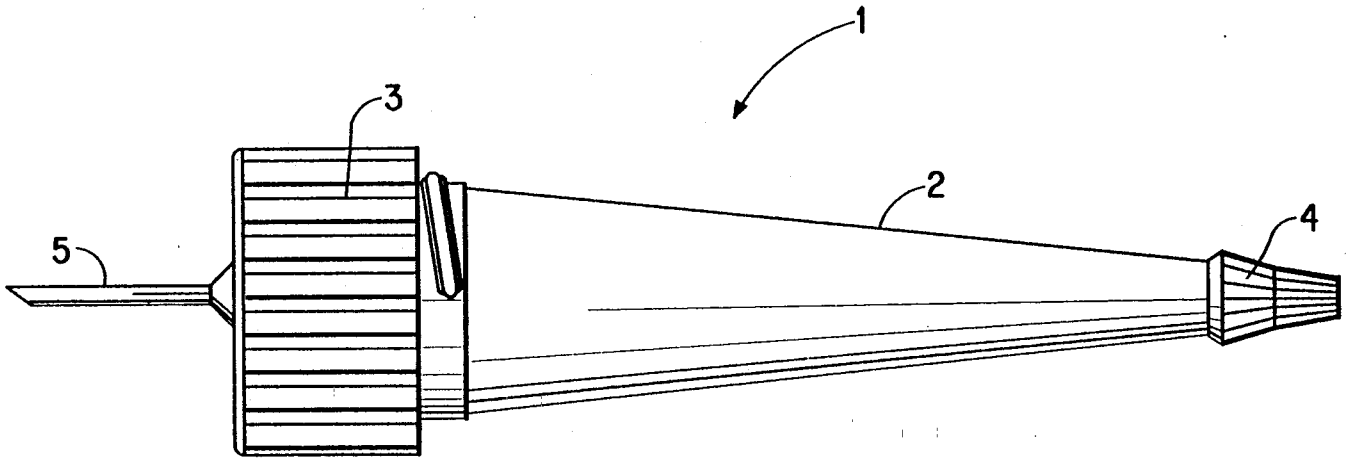
FIG. 1 is a schematic representation of a side view of an embodiment of the dispensing pipette of the invention.

FIG. 1 shows a dispensing pipette, generally indicated by 1, having an elongated hollow cone 2 with unitary cap 3 and tip cap 4. Unitary cap 3 and tip cap 4 are attached by threaded engagement to opposing ends of elongated hollow cone 2. Unitary cap 3 has a piercing bayonet 5 that is located, preferably axially, on unitary cap 3 and extends externally therefrom; piercing bayonet 5 is shown as being axial, and is conveniently but not necessarily so. Similarly, piercing bayonet 5 is preferably linear for ease of manufacture. Dispensing pipette 1 is preferably symmetrical about its longitudinal axis.

Figure 2:
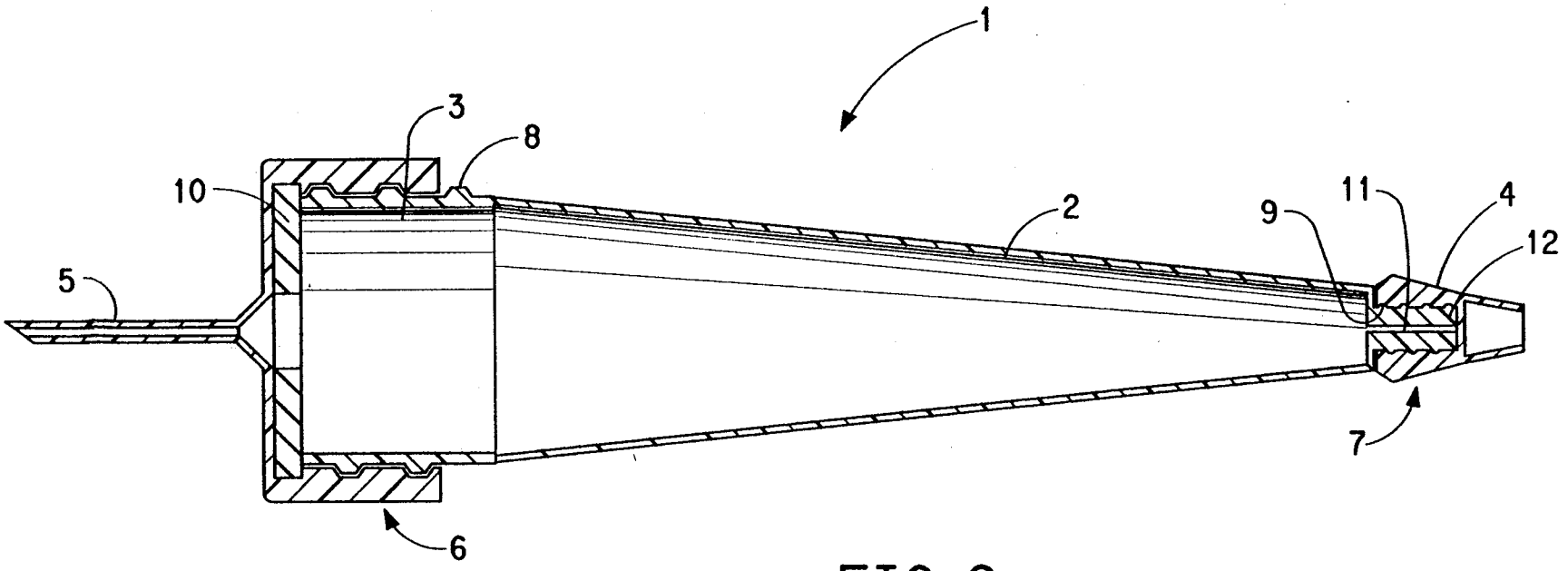
FIG. 2 is a schematic representation of a cross-section of the embodiment of FIG. 1.

Dispensing pipette 1 is shown in cross-section in FIG. 2. Elongated hollow cone 2 tapers from inlet end 6 towards dispensing end 7. Both inlet end 6 and dispensing end 7 of elongated hollow cone 2 have external threads, 8 and 9 respectively, which are in threaded engagement with unitary cap 3 and tip cap 4. Gasket 10 is located within unitary cap 3, and forms a seal between the inlet end 6 of elongated hollow cone 2 and the interior surface of unitary cap 3. Channel 11 extends through dispensing end 7, forming fluid communication between the interior of elongated hollow cone 2 and tip 12; channel 11 is of a bore that permits controlled dispensing of fluid from elongated hollow cone 2.

Figure 3:
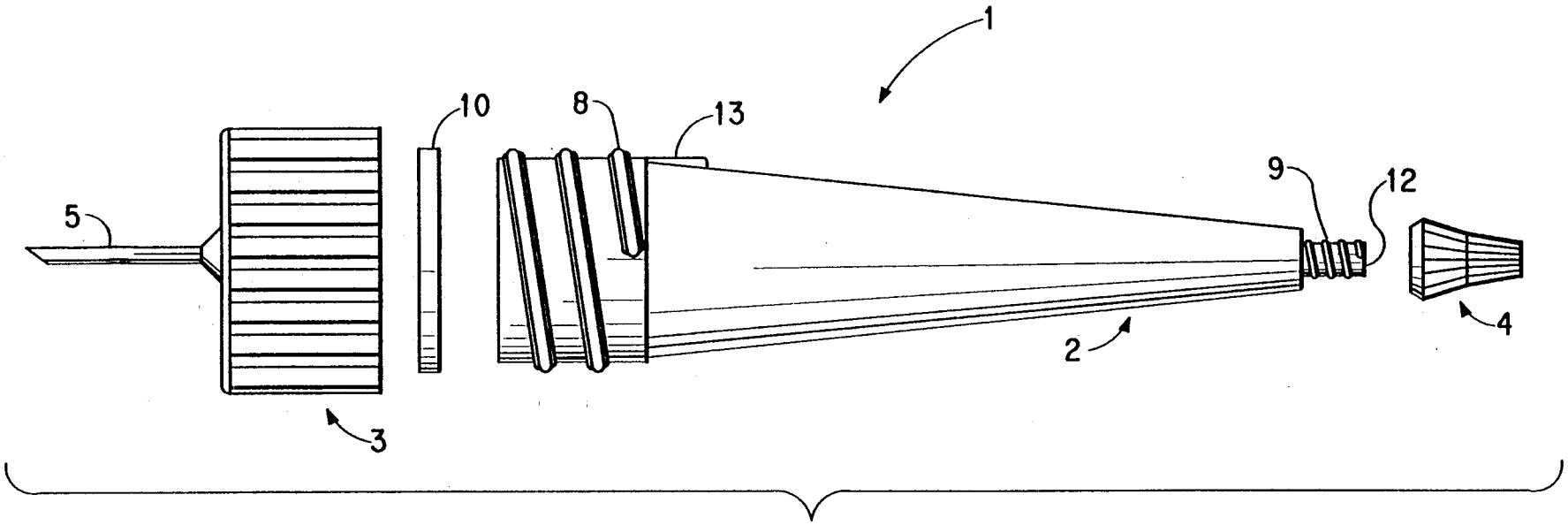
FIG. 3 is an exploded view of the dispensing pipette of FIG. 1.

FIG. 3 shows dispensing pipette 1 in an exploded view. Elongated hollow cone 2 tapers from inlet end 6 towards dispensing end 7, with inlet end 6 having external threads 8 and dispensing end 7 having external threads 9. External threads 8 and 9 are adapted to engage with unitary cap 3 and tip cap 4 respectively. Gasket 10 is located within unitary cap 3. Channel 11 extends through dispensing end 7, forming fluid communication between the interior of elongated hollow cone 2 and tip 12. Hollow cone 2 may have tab 13 on the external surface thereof, adjacent unitary cap 3, for ease of handling, tab 13 optionally resulting from the gate during injection moulding of hollow cone 2.

In operation, unitary cap 3 (with gasket 10) is screwed onto inlet end 6 of elongated hollow cone 2. Similarly, tip cap 4 is screwed onto dispensing end 7 of elongated hollow cone 2. Piercing bayonet 5 is forced through the stopper of a stoppered vial containing blood or blood components; stoppered vials are widely known in the art. Piercing bayonet 5 has a channel therein of a bore that does not core on the piercing of the stopper; "coring" means partial or complete blockage of the piercing bayonet by portions or fragments of the stopper. Squeezing of elongated hollow cone 2 causes air to pass through piercing bayonet 5 into the stoppered vial; when pressure on elongated hollow cone is released i.e. the squeezing is stopped, blood or blood component is drawn back into elongated hollow cone 2. The squeezing procedure may occur until hollow cone 2 is filled; additional squeezing has no benefit and should be avoided. With piercing bayonet 5 still inserted into the stoppered vial, tip cap 4 is removed from dispensing end 7. The threaded engagement of tip cap 4 with dispensing end 7 results in a controlled equalization of air pressure between the inside and outside of dispensing pipette 1; in contrast, a simple push-on style cap would give a sudden "puff" on equalization of pressure, with a release of blood component in an atomized or aerosol form, possibly into the face of the person using the dispensing pipette. Inverting the dispensing pipette into a tip-down orientation permits dispensing of controlled amounts of blood component by gentle squeezing of elongated hollow tube 2.

The dispensing pipette of the present invention may be used with stoppered vials of various materials e.g. butyl rubber and thermoplastic elastomer stopper, and with various diameters and shapes, as the piercing bayonet passes through the stopper without any need for the dispensing pipette to pass over the exterior and/or lock onto the vial in any manner. There is no need to remove the stopper from the vial, and thus there is no danger of contamination of the blood sample, of spillage and/or venting or of health hazards to persons obtaining samples from the vial. Typically blood specimens may be stored in a refrigerated condition for up to about two weeks, so that the specimens are available for further testing or re-testing; blood vials are usually stored in a plastic bag, especially to prevent contamination and evaporation, but the dispensing pipette of the present invention would prevent evaporation and contamination because of the dispensing tip and the end cap. The dispensing pipette remains with the tube, for re-use in the dispensing of any additional samples. The pipette and blood collection tube may be disposed of as a unit, by incineration.

The reclosable nature of the tip cap offers advantages because it is leak tight. For instance, blood or serum could be redistributed back into the vial, with the pipette being removable as a closed system. This feature is believed to be unique, as it is understood that other designs of dispensing pipettes are not leak proof under the pressures needed to redistribute blood or serum back to the vial.

The dispensing pipette may be manufactured from known materials e.g. using injection moulding techniques, and offered for sale in a pre-assembled form, suitable for immediate use. For example, the unitary cap with piercing bayonet may be injection moulded from an acetal polymer e.g. Delrin® polyacetal available from E. I. du Pont de Nemours and Company of Wilmington, Del., U.S.A. Such a polymer exhibits a unique combination of stiffness and toughness suitable for functioning as the piercing bayonet as well as lubricious characteristic facilitating insertion of the bayonet through the stopper of a vial. The cone may be manufactured from polyethylene or other polyolefins, as may the tip cap. Suitable semi-rigid or flexible gaskets are known. Use of polymers such as acetal polymers and polyolefins permits disposal of the dispensing pipette in, for example, hospital incinerators without formation of compounds other than water and oxides of carbon, principally carbon dioxide.

The channel in the dispensing tip should be of dimensions that permit precise dispensing of droplets of blood components e.g. onto a microscope slide, or the dispensing of larger quantities of blood components. The hollow cone could have marks thereon to indicate volume, for assistance in dispensing a particular volume of liquid.

A filter may be inserted into the cone, for example Q in the orifice of the gasket or adjacent the fluid channel of the dispensing end of the dispensing pipette, for filtration of blood samples e.g. filtration of fibrin from serum, passing through the dispensing pipette. Examples of such filters include Porex® disk filters; other filters may be used for filtration of blood cells or platelets.

As an example, a dispensing pipette was fabricated with a cone having a length of 3.6 cm, tapering from a diameter of 1.2 cm to a diameter of 0.51 cm. The tip was 0.64 cm in length and had a channel with a diameter of 0.10 cm. The threads on the tip made three rotations around the tip. Both the cone and the tip cap were injection mould from Chevron PE-1007 polyethylene having a density of 0.918 g/cm$^3$ and a melt index of 7.0 dg/min. The unitary cap was injection moulded from Delrin® 900 NC10 polyacetal. The bayonet had a length of 1.6 cm and a channel with a diameter of 0.10 cm. The gasket had a thickness of 0.51 mm, an external diameter (OD) of 1.2 cm and an internal diameter of 0.64 cm. This dispensing pipette was successfully used, without difficulty, in the dispensing of blood from a stoppered vial.

I claim:

1. Apparatus for dispensing blood or blood components from a stoppered vial containing such components, comprising in combination:

(a) a flexible elongated hollow cone that tapers from an inlet end to a dispensing end, each of said ends having external threads;

(b) a unitary cap in threaded engagement with the external threads of the inlet end of the cone, said unitary cap having an internal gasket forming an effective seal between the end of the hollow cone and the interior of the unitary cap, said unitary cap having a tubular piercing bayonet extending outwardly from said cap with dimensions suitable for penetration of a stopper on a stoppered vial without coring;

(c) said dispensing end terminating in a tip with a fluid channel for the dispensing of droplets of liquid from said tip, said dispensing end having a threaded cap in threaded engagement with the external threads on the dispensing end of the cone, said external threads being effective in permitting controlled pressure equalization between the interior of the hollow cone and the atmosphere on removal of said cap.

2. The apparatus of claim 1 in which the tubular piercing bayonet is axial and linear.

3. The dispensing pipette of claim 2 in which the unitary cap is formed from an acetal polymer.

4. The dispensing pipette of claim 2 in which the flexible elongated hollow cone and the threaded cap are formed from a polyolefin.

5. The dispensing pipette of claim 4 in which the polyolefin is polyethylene.

6. The dispensing pipette of claim 2 that may be disposed of by incineration without health hazard.

7. The dispensing pipette of claim 2 in which a filter is placed in the gasket.

8. The dispensing pipette of claim 2 in which a filter is placed in the hollow cone.

* * * * *